US007942121B2

(12) United States Patent
Lunsford et al.

(10) Patent No.: US 7,942,121 B2
(45) Date of Patent: May 17, 2011

(54) CAMSHAFT SYSTEM FOR INTERNAL COMBUSTION ENGINE

(75) Inventors: Robert Wayne Lunsford, Novi, MI (US); Mike David Deegan, Farmington Hills, MI (US); Daniel Lawrence Sylvester, West Bloomfield, MI (US); Robert Stephen Furby, Novi, MI (US)

(73) Assignee: Ford Global Technologies, Dearborn, MI (US)

( * ) Notice: Subject to any disclaimer, the term of this patent is extended or adjusted under 35 U.S.C. 154(b) by 331 days.

(21) Appl. No.: 12/194,160

(22) Filed: Aug. 19, 2008

(65) Prior Publication Data

US 2010/0043736 A1 Feb. 25, 2010

(51) Int. Cl.
*F01M 1/06* (2006.01)

(52) U.S. Cl. ..... 123/90.34; 123/90.17; 123/90.31

(58) Field of Classification Search ..... 123/90.15, 123/90.17, 90.31, 90.34
See application file for complete search history.

(56) References Cited

U.S. PATENT DOCUMENTS

| | | | | |
|---|---|---|---|---|
| 4,957,079 | A * | 9/1990 | Nakatani et al. | 123/90.34 |
| 5,816,205 | A * | 10/1998 | Moriya | 123/90.17 |
| 5,954,019 | A * | 9/1999 | Yoshikawa et al. | 123/90.17 |
| 6,382,173 | B1 | 5/2002 | Roe | |
| 6,439,176 | B1 | 8/2002 | Payne et al. | |
| 6,782,856 | B2 | 8/2004 | Aimone | |
| 6,871,620 | B2 | 3/2005 | Aimone | |
| 2004/0079307 | A1 | 4/2004 | Dinkel et al. | |

FOREIGN PATENT DOCUMENTS

| | | |
|---|---|---|
| EP | 0215713 | 7/1988 |

* cited by examiner

*Primary Examiner* — Zelalem Eshete
(74) *Attorney, Agent, or Firm* — Jerome R. Drouillard; Julia Voutyras

(57) ABSTRACT

A camshaft system for internal combustion engine includes a camshaft having a thrust ring which is lubricated by oil from a control valve which operates a camshaft phaser with lubricating oil, and with the lubricating oil being furnished to the camshaft at crankcase pressure after the oil leaves the camshaft phaser.

2 Claims, 3 Drawing Sheets

CAMSHAFT SYSTEM FOR INTERNAL COMBUSTION ENGINE

CROSS REFERENCE TO RELATED APPLICATIONS

None.

BACKGROUND OF THE INVENTION

1. Field of the Invention

The present invention relates to a camshaft system for operating cylinder poppet valves incorporated within internal combustion engine, where the camshaft has a controlled timing or phasing, and with lubricating oil serving the dual function of not only operating camshaft phaser, but also providing lubrication for a portion of the camshaft.

2. Background Information

The lubrication of moving parts within an internal combustion engine is both necessary and costly. Of course, lubrication must be furnished to prevent undue wear of moving parts, but also to provide a mechanism for facilitating heat transfer. Lubrication is costly because a pump and a transfer network must be provided, with the pump having sufficient capacity to service a wide variety of moving parts and engine operating regimes. In the case of moving parts such as a camshaft, this lubrication requirement extends to lubrication of the camshaft's thrust faces. Usually, camshaft lubrication needs dictate that drilled passages be provided in opposing sides of the structures to which the camshaft's thrust surfaces abut. However, this necessitates that the oil pump be sized for a significant leakage path; this means that the pump must have greater capacity and, also, that the pump will absorb more power.

It would be desirable to be able to furnish lubrication to camshaft thrust faces without the need of providing additional oil pump capacity and without the need for providing specialized drilled or cored passages within a cylinder head of an overhead cam engine.

SUMMARY OF THE INVENTION

A camshaft system for an internal combustion engine includes a cylinder head, with a camshaft mounted upon a number of bearing surfaces contained in the cylinder head. A thrust ring is incorporated in the camshaft. A combination lubricant reservoir and thrust reactor is formed in the cylinder head and receives the thrust ring. A control valve for operating a camshaft phaser is connected with the cylinder head. The control valve furnishes lubricating oil under pressure to the camshaft phaser. At least one lubricant drain passage conducts lubricating oil from the control valve. The oil first enters the phaser, and is then conducted to the combination lubricant reservoir and thrust reactor.

According to another aspect of the present invention lubricating oil leaves the control valve and entering the lubricant reservoir and thrust reactor at crankcase pressure.

According to another aspect of the present invention, the combination lubricant reservoir and thrust reactor includes a generally semi-circular pocket having front and rear axial thrust faces for engaging the camshaft's thrust ring.

According to another aspect of the present invention, two camshafts may be provided with lubricant for their thrust rings by a single control valve operating a single camshaft phaser mounted to one of the camshafts.

It is an advantage of the present invention that because lubricant which is provided to the camshaft thrust surfaces is at crankcase pressure, maximum oil pressure is available to operate the camshaft phaser supplied with oil by the control valve.

It is a further advantage of a system according to the present invention that oil pump capacity may be reduced because of the lack of a need to provide oil under pressure for the camshaft's thrust surfaces.

Yet another advantage of a system according to the present invention resides in the notion that a single camshaft phaser control valve may be used for providing camshaft thrust surface lubrication for both of the camshafts found in a single cylinder head of a dual overhead camshaft engine.

Other advantages, as well as features of the present invention, will become apparent to the reader of this specification.

DETAILED DESCRIPTION OF THE PREFERRED EMBODIMENTS

Figure 1:
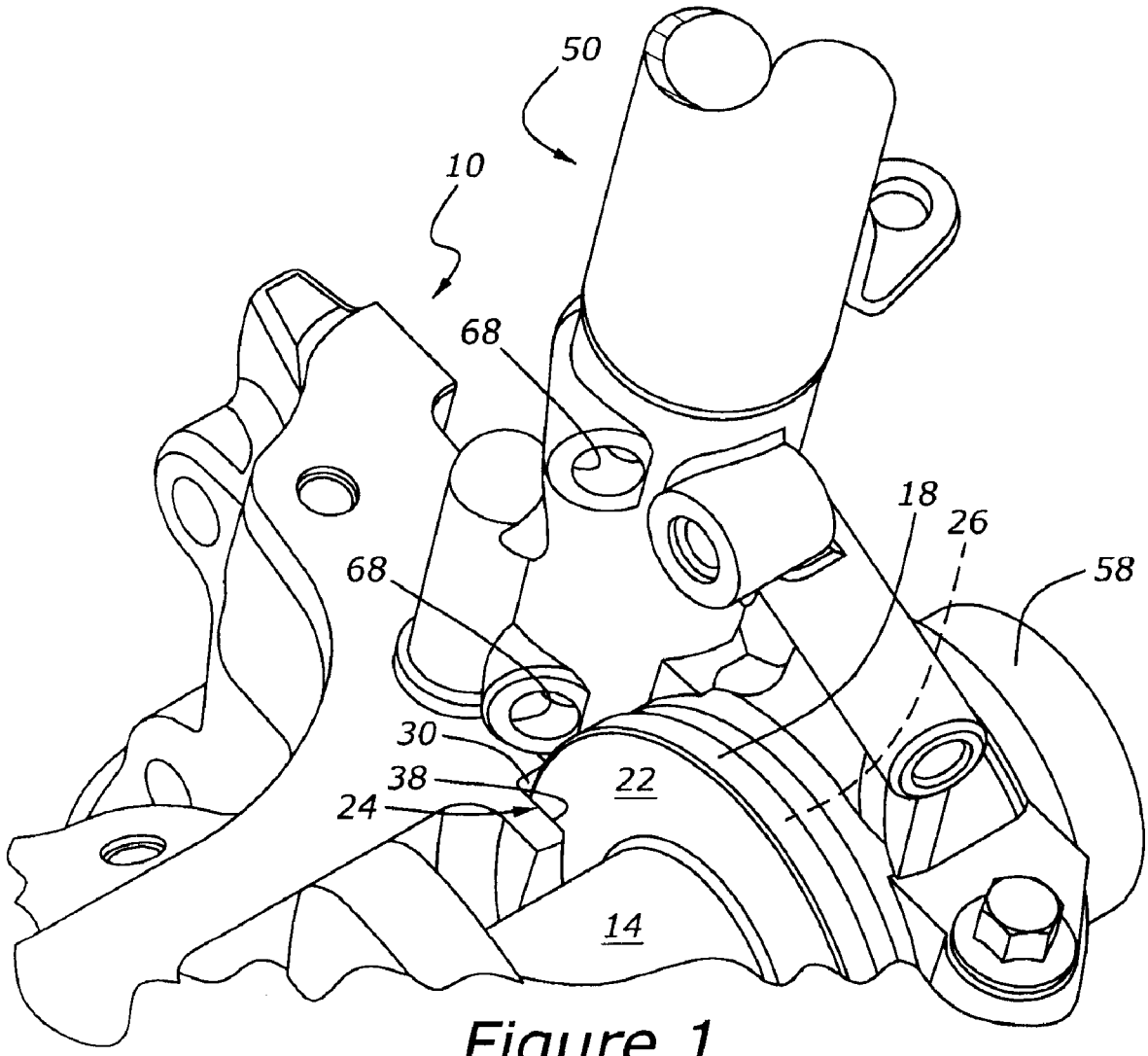
FIG. 1 is a perspective view of a portion of a cylinder head having a control valve and camshaft arrangement according an aspect of the present invention.

As shown in FIG. 1, an engine cylinder head, 10, has a camshaft, 14, mounted therein upon a number of camshaft bearings, with one bearing, 46, being illustrated. Camshaft 14 incorporates an integral, one-piece camshaft thrust ring, 18, which has a rear thrust face, 22, and a front thrust face, 26, with the latter being best shown in FIG. 2.

Figure 2:
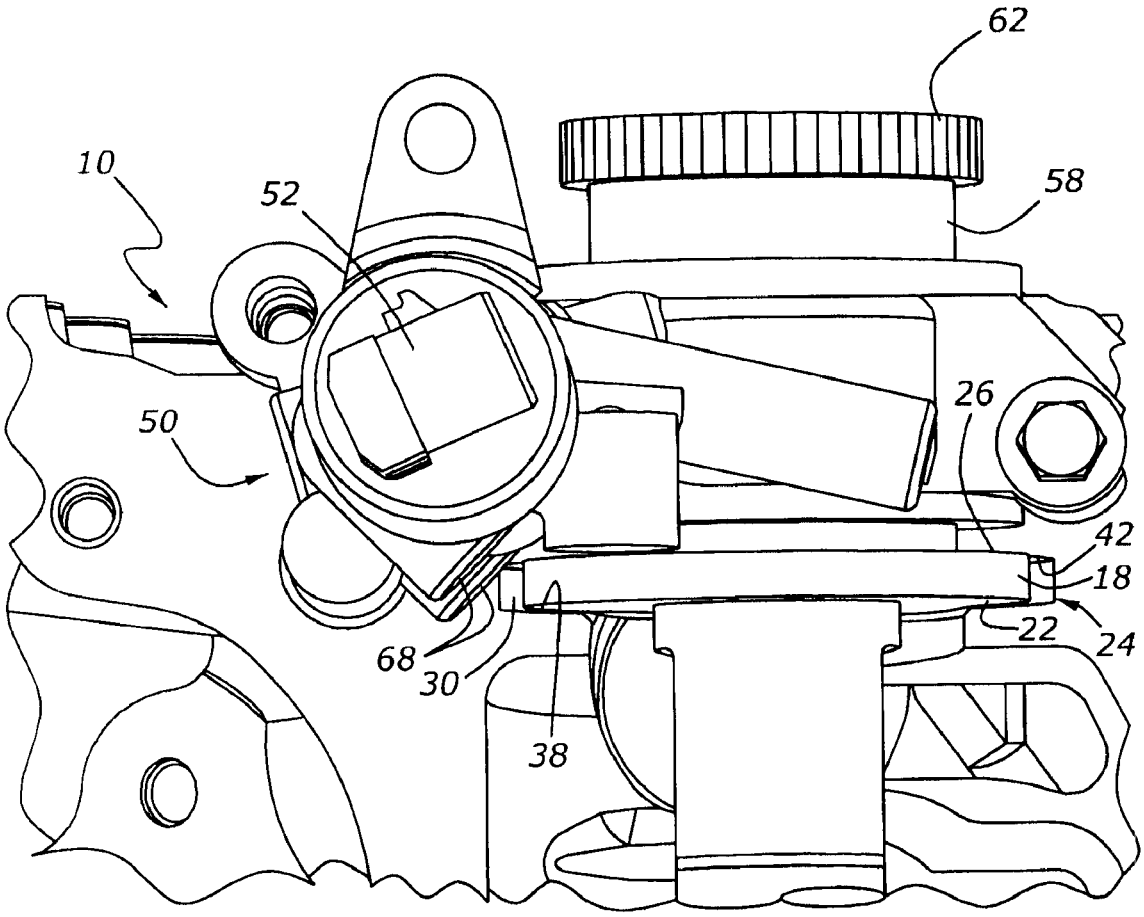
FIG. 2 is a plan view of a portion of a cylinder head similar to that shown in FIG. 1.

FIG. 1 also shows an oil control valve, 50, which provides lubricating oil under pressure to camshaft phaser, 58, which is shown in FIGS. 1 and 2. FIG. 2 also shows a camshaft sprocket, 62, which is mounted upon camshaft phaser, 58, and which powers camshaft 14 through either an elastomeric, fiber-reinforced belt, or a chain, or for that matter, a gear drive.

Figure 3:
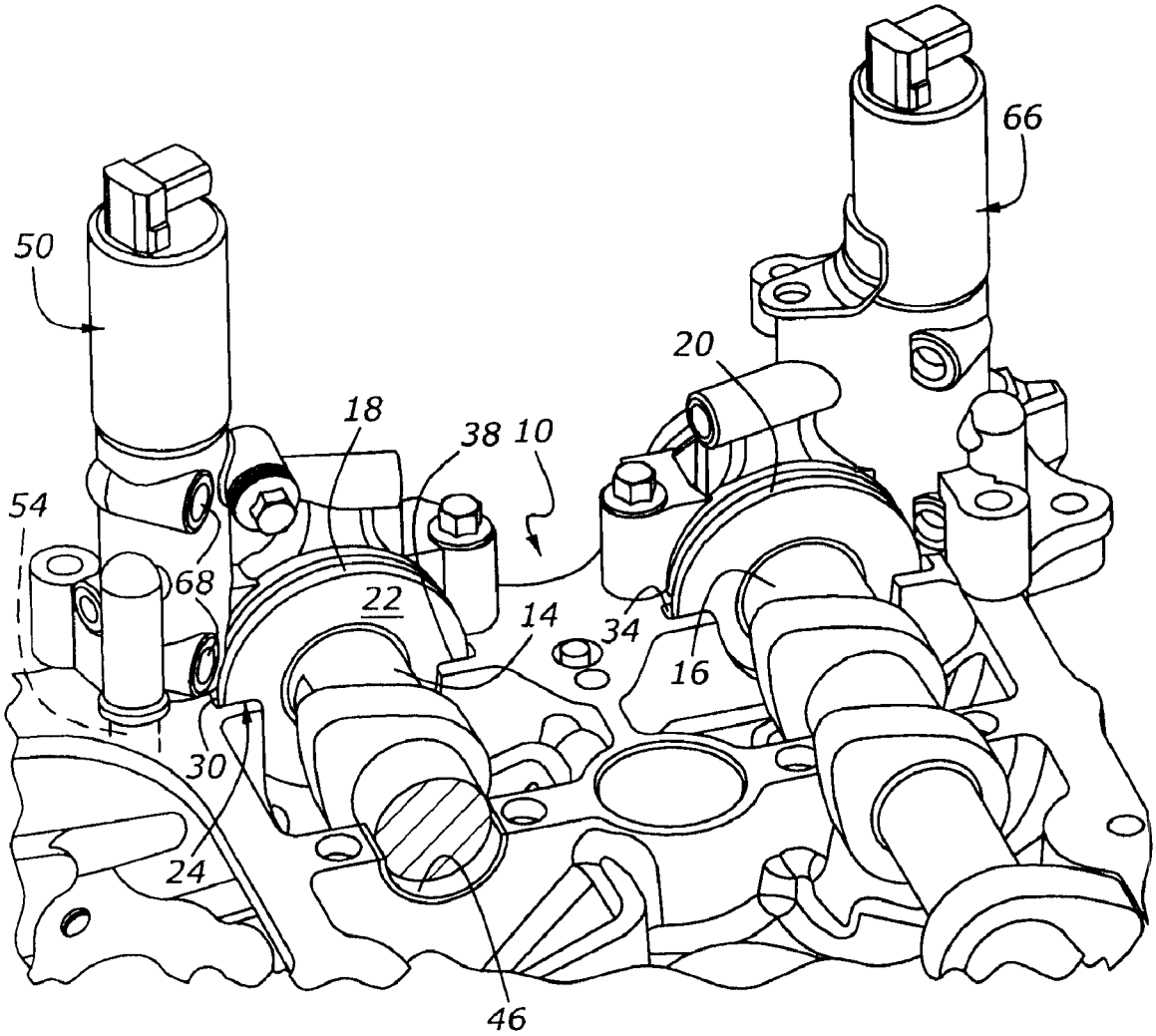
FIG. 3 is a perspective view of a cylinder head having dual overhead camshafts and two camshaft phasers and control valves according to the present invention.

Control valve 50 receives oil ported through a supply passage, 54, formed in cylinder head 10 (FIG. 3), and provides oil to camshaft phaser 58 such that oil is constantly flowing through control valve 50. As a result, a stream of "used oil" continually flows through ports 68 formed in control of the body of control valve 50; ports 68, which function as drain passages for valve 50, are shown in FIGS. 1, 2 and 3. It is a feature of commonly used camshaft phaser control valves that oil flows from the valves and is not merely deadheaded at the camshaft phaser. In other words, whether the camshaft timing is advanced or retarded fully, or somewhere in between, oil will leave ports 68. The present invention takes advantage of this continuous flow of oil, but without adding further burden to the engine's oil pump. The latter advantage is achieved by using post-phaser oil, at crankcase pressure, to lubricate one or more camshafts.

Oil which flows from ports 68 ultimately flows, across cylinder head 10 and into a combination lubricant reservoir and thrust reactor, 24 (FIGS. 1, 2, and 3). This combination device includes a semicircular pocket, 30, into which lubricant flows at crankcase pressure. Pocket 30 has a rear axial thrust face, 38, which is shown in FIGS. 1, 2 and 3, and a front axial thrust face, 42, which is best shown in FIG. 2. Because oil flows constantly from ports 68 of control valve 50 whenever the engine is operating, oil flows into pocket 30 and fills the pocket to the extent it is permitted by virtue of the semi-annular wall which defines rear thrust face 38.

As is clearly shown in FIG. 2, pocket 30 has an overall diameter which exceeds the diameter of camshaft thrust ring 18 and this situation provides a ready passage for oil leaving lubricant drain passages 68 on control valve 50. FIG. 2 also shows an electrical connector, 52, for control valve 50.

Although FIG. 3 shows two control valves, namely valve 50 and valve 66, which are attached to cylinder head 10, and which both serve to lubricate camshaft thrust rings, it should be appreciated that the present oiling system may be employed with a single control valve, usually on the intake side of the engine, which in this case would be valve 50. It has been determined that sufficient lubrication for camshaft thrust ring 20 of camshaft 16 will flow across cylinder head 10, particularly with a V-type engine in which the cylinder heads are inclined at a negative angle to the horizontal. This inclination allows oil to overflow from pocket 30 and down into a second pocket, 34, shown in FIG. 3, so as to provide lubrication to camshaft thrust ring 20, which is located upon a second camshaft, 16. In this manner, the thrust rings of both camshafts 14 and 16 may be lubricated with oil coming from a single control valve, namely valve 50, thereby disposing with the need for drillings within cylinder heads to provide either of thrust rings 18 or 20 with lubrication.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A camshaft system for an internal combustion engine, comprising:

a cylinder head;

at least one camshaft mounted upon a plurality of bearing surfaces contained in said cylinder head;

at least one annular thrust ring incorporated in said at least one camshaft;

a first combination lubricant reservoir and thrust reactor, formed in said cylinder head, for engaging said thrust ring;

a control valve, mounted to said cylinder head, for operating a camshaft phaser, with said control valve furnishing lubricating oil under pressure to said camshaft phaser;

at least one lubricant drain passage for conducting post-phaser lubricating oil from the control valve to the combination lubricant reservoir and thrust reactor at crankcase pressure; and a second combination lubrication reservoir and thrust reactor formed in the cylinder head, with said second combination reservoir and thrust reactor being furnished with lubricant overflowing from said first combination reservoir and thrust reactor.

2. A camshaft system according to claim 1, wherein said second combination lubrication reservoir and thrust reactor is operatively associated with a second camshaft mounted within said cylinder head.

* * * * *